US005195565A

United States Patent [19]

Owen et al.

[11] Patent Number: 5,195,565

[45] Date of Patent: Mar. 23, 1993

[54] VARIABLE STROKE LIFTER SYSTEM

[75] Inventors: Barry C. Owen, Southfield; Timothy H. Drury, Howell, both of Mich.

[73] Assignee: Elopak Systems A.G., Glattbrugg, Switzerland

[21] Appl. No.: 775,005

[22] Filed: Oct. 11, 1991

[51] Int. Cl.[5] ..... B65B 43/50

[52] U.S. Cl. ..... 141/148; 141/84; 141/152; 141/177; 141/266

[58] Field of Search ..... 141/84, 148, 149, 150, 141/151, 152, 177, 266

[56] References Cited

U.S. PATENT DOCUMENTS

| | | | |
|---|---|---|---|
| 2,720,020 | 10/1955 | Meyer | 141/148 |
| 3,580,302 | 5/1971 | Riesenberg | 141/152 X |
| 4,122,876 | 10/1978 | Nalbach | 141/150 |

FOREIGN PATENT DOCUMENTS

| | | | |
|---|---|---|---|
| 353467 | 9/1921 | Fed. Rep. of Germany | 141/148 |
| 625827 | 1/1936 | Fed. Rep. of Germany | 141/148 |
| 1182909 | 7/1959 | France | 141/148 |

*Primary Examiner*—Ernest G. Cusick

*Attorney, Agent, or Firm*—Reising, Ethington, Barnard, Perry & Milton

[57] ABSTRACT

A variable stroke lifter system for lifting a container so as to surround a filler nozzle for "bottom-up" filling thereof. The lifter system includes a pivotally mounted slide arm, a lift arm operatively connected to the slide arm for movement therewith, a plurality of different size cams, a follower secured to the slide arm for cooperation with the plurality of cams for raising the lift arm. The lift arm engages a container to lift same. A series of suitable actuator devices, such as air cylinders, serve to position the slide arm and follower to engage selected cams for raising particular size containers through the desired stroke length.

9 Claims, 1 Drawing Sheet

VARIABLE STROKE LIFTER SYSTEM

TECHNICAL FIELD

This invention relates generally to apparati for filling containers with a liquid and, more particularly, to a cam and lever lifting system providing differing stroke lengths for lifting different size containers to be filled by a "bottom-up" filling technique.

BACKGROUND ART

For filling containers with liquids, it is well-known to use a so-called "bottom-up" filler technique in order to eliminate the build-up of foam. In this technology, either the filler nozzle is lowered into the container and then raised during the filling operation, or the container is lifted around the filler nozzle and then lowered during the filling operation, with the two separating at a rate commensurate with the flow rate of the liquid.

When it is the container which is lifted and then lowered, it has been customary to employ either a vacuum system wherein a vacuum cup on the end of a vertical actuator engages the bottom surface of the container, or a system wherein a cross bar is mounted on the end of the vertical actuator, without a vacuum cup.

The vacuum cup or the cross bar typically are mounted on the upper end of a stem connected to the end of an air cylinder piston. A satisfactory vacuum arrangement is shown and described in McDonald et al U.S. Pat. No. 4,712,665.

Various cam arrangements are also known for lifting a container from a shelf or conveyor to accommodate bottom-up filling thereof as the container is lowered from around a filler nozzle, for example, Dolley et al U.S. Pat. No. 594,257; Geyer U.S. Pat. No. 1,993,367; Saeta U.S. Pat. No. 2,100,359; Saeta U.S. Pat. No. 2,142,257; Bridge U.S. Pat. No. 2,605,948; Lange U.S. Pat. No. 2,896,381; King U.S. Pat. No. 4,084,626; and Stohlquist U.S. Pat. No. 4,388,795.

Of the above referenced patents, only two, namely, Saeta U.S. Pat. Nos. 2,100,359 and 2,142,257 disclose means for changing the lift height to accommodate different size containers. Each includes a crank-disk side-by-side and integral with a single cam, with bolt-receiving apertures at different radii to vary the stroke of a pitman to accommodate different capacity containers.

A prior arrangement for lifting containers to be filled is also known, wherein a plurality of cams are moved laterally relative to a fixed cam follower roller. Also known is an arrangement wherein a container lift arm moves laterally with a cam follower roller relative to a pair of adjacent fixed cams. The lift arm pivots beneath a platform which supports a container to be lifted.

DISCLOSURE OF THE INVENTION

A general object of the invention is to provide an improved lifting system for lifting different size containers to be filled by a bottom-up filling technique.

Another object of the invention is to provide an improved cam and lever lifting system providing different stroke lengths for lifting different size containers to a position around a fixed filler nozzle to be filled with a liquid via a bottom-up filling technique.

A further object of the invention is to provide a cam and lever lifting system including multiple cams for different resultant stroke lengths, wherein a bank of air cylinders or other suitable means are selectively actuated to position a slide arm and follower to engage a desired cam, with the slide arm slidably connected to a lift arm so as to lift same and, thereby, to lift empty containers from a holding device, such as a pocket on a conveyor, to position the container with respect to a filler nozzle for filling with a liquid.

These and other objects and advantages will become more apparent when reference is made to the following drawings and the accompanying description.

BEST MODE OF CARRYING OUT THE INVENTION

Figure 2:
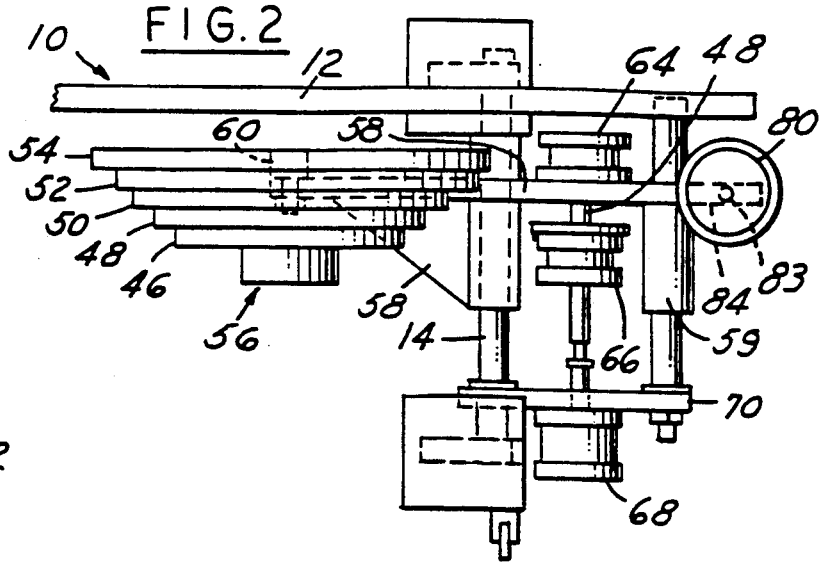
Figure 1:
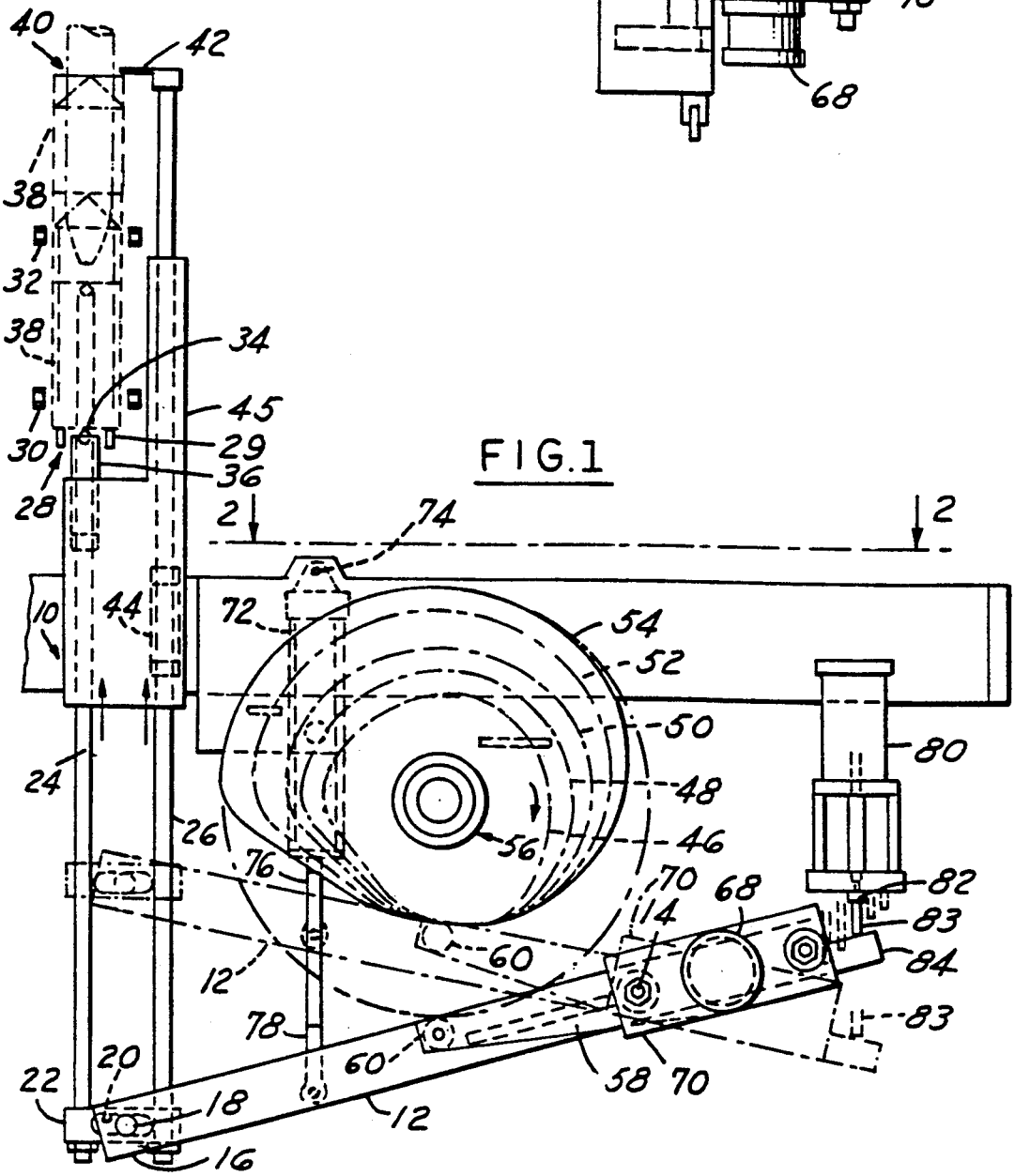
FIG. 1 is side elevational view of a container lifting system embodying the invention; an FIG. 2 is a fragmentary top view taken along the plane of the line 2—2 of FIG. 1, and looking in the direction of the arrows.

Referring now to the drawings in greater detail, FIGS. 1 and 2 illustrate a lifting system 10 including a lift arm 12 pivotally mounted on an elongated pivot member 14 at an intermediate point therealong. The end 16 of the lift arm 12 is pivotally connected by any suitable means, such as roller 18 in a camming slot 20 formed in a block 22. A pair of parallel rods 24 and 26 extend upwardly from the block 22 for vertical movement therewith. A container indexing device (driving means not shown), represented at 28, may be pairs of upper and lower chains 30 and 32 with corresponding drive lugs formed thereon. Carton bottom guides 29 may be vertically positioned by any suitable external means (not shown) to suit different container heights. A lift bar 34 is adjustably mounted by any suitable means, represented at 36, at the upper end of the rod 24, to coordinate with the position of the carton guide 29 adaptable to engage the bottom surface of a container 38 to raise same to a position around a filler nozzle 40 to fill the container by the so-called bottom-up technique, i.e., lowering the container 38 from around the filler nozzle during the filling operation at a rate commensurate with the flow rate of the liquid.

A retract-assist finger 42 is mounted at the upper end of the rod 26, adaptable to engage the upper edge of the container 38 while it is being lowered by the lift arm 12. If necessary, the height of the finger 42 may be adjusted for particular container heights by any suitable adjustment means, represented at 44. A guide member 45 serves to guide the rods 24 and 26 during their vertical movements.

A plurality of cams 46, 48, 50, 52, and 54 are positioned along side (FIG. 2) and above (FIG. 1) the lift arm 12. The cams are secured to shaft means 56 which is rotatably connected to suitable drive means (not shown).

A slide arm 58 is slidably and pivotally mounted on the elongated pivot member 14, and slidably connected by any suitable connector means, represented at 59, to the lift arm 12 such that the latter moves vertically with the vertical movement of the slide arm, as will be described. A cam follower 60 is rotatably mounted on one end of the slide arm 58 adjacent the plurality of cams.

A first of a series of suitable actuator means, such as servo motor, manual operated threaded means, or, as selected for illustration, air cylinders 64, 66, and 68, is mounted on a base plate 70. The cylinder 64 is operatively connected to the slide arm 58 so as to extend or retract the cam follower 60, as required to selectively engage respective cams 46, 48, 50, 52 and 54. If air cylinders are used, the sequence of cam engagements and, hence, lift arm 12 operation, with respect to respective cylinder 64, 66 and 68 actuations would vary from all three cylinders being extended, for example, to align the follower 60 with the furthermost cam 46, to all three cylinders being retracted to align the follower 60 with the first-in-line cam 54.

An air cylinder 72 (FIG. 1) is connected at the upper end thereof to a seat 74, while the piston 76 thereof is secured to an end rod 78 which is pivotally mounted on the lift arm 12 intermediate the pivot member 14 and the end 16. Inasmuch as the slide arm 58 is secured for vertical movement with the lift arm 12, the air cylinder 72 secured to the latter arm serves, when retracted, to retain the cam follower 60, which may be a roller rotatably mounted on the slide arm 58, against any selected one of the cams 46, 48, 50, 52, and 54 while the cams are being rotated to thus lift and lower the lift arm 12. When extended, the air cylinder 72 serves to hold the cam follower 60 away from the respective cams for realignment via the slide arm 58 with a different cam.

The position of the retract-assist finger 42 (FIG. 1) is adjustable relative to the lift bar 34, such that the highest lift position thereof may vary for respective container 38 sizes, while its lowest position may be a common position for all container sizes. The corresponding highest and lowest lift positions for the lift bar 34 may be such that the highest position thereof is common for all container 38 sizes, and the lowest position thereof variable. Where necessary, for a particular container 38 height, any of the cams may, of course, be shaped to produce different highest and lowest lift positions.

As shown rotated 90° in FIG. 1, a cylinder 80 includes a piston 82 having adjustable stops 83 mounted on the distal end thereof, suitable for particular container sizes, and selected to complement the motion provided by a corresponding cam 46, 48, 50, 52 or 54. The selected stop 83 abuts against the rear end 84 of the slide arm 58, adapted to limit the extending ability of the air cylinder 72. For each container 38 size, the cylinders 64, 66 and 68 are actuated as required (FIG. 3) to reposition the cam follower 60 or 62 adjacent a selected cam 46, 48, 50, 52 or 54. While repositioning, the cylinder 80 is retracted to prevent interference between the stop 83 and the end 84.

Thereafter, as the newly selected cam is rotated, as may be determined from a review of FIG. 1, the container of a particular size will be lifted vertically through a particular stroke length to its highest lift position by the resultant vertical movement of the lift bar 34. In the event no container 38 is present during any cycle, the air cylinder 72 is programmed to extend and hold the follower 60 away from a cam, and thereby cause the lift arm 12 to remain stationary. Simultaneously, the filler nozzle 40 will not be actuated.

INDUSTRIAL APPLICABILITY

It should be apparent that the invention provides an efficient, compact lifting system through different selected stroke lengths for lifting different size containers to be filled by a bottom-up filling technique.

It should also be apparent that the number and sizes of cams in the system may vary to coincide with the number of different size containers which are to be filled.

It should also be realized that the lift bar 34 at the upper end of the rod 24 may be of a length sufficient to lift two or more aligned containers to accommodate two or more filler nozzles, such as on a double or quadruple track forming, filling and sealing machine.

While but one embodiment of the invention has been shown and described, other modifications are possible within the scope of the following claims.

The embodiment of the invention in which an exclusive property or privilege is claimed are defined as follows:

1. In a lifting system adapted to lifting different size containers from a holding device for bottom-up filling thereof by a filler nozzle, said system including pivotally mounted lift arm means for lifting said containers, pivotally and slidably mounted slide arm means operatively connected to said lift arm means for turning therewith, laterally fixed, rotatably mounted camming means having differing camming profiles, cam follower means mounted on said slide arm means, and actuator means for laterally moving said slide arm means with respect to said camming means to thereby reposition said cam follower means adjacent a different selected camming profile, characterized in that said lift arm means is laterally fixed and that said actuator means serves to move said slide arm means laterally with respect to said lift arm means.

2. The lifting system described in claim 1, wherein said holding device includes pairs of lugs of a conveyor chain.

3. The lifting system described in claim 1, wherein said lift arm means includes a pivotally mounted lift arm, a vertically oriented lift rod mounted on the lifting end of said lift arm, with a lift bar operatively connected to the rod for engaging the bottom surface of the container to lift same.

4. The lifting system described in claim 3, and a second rod parallel to said lift rod and having a retract-assist finger formed at the upper end thereof adapted to engage the upper edge of the container to assist same during the retraction operation after the container has been filled.

5. The lifting system described in claim 3, and means for retaining said cam follower means against a selected camming profile, wherein said retaining means is an air cylinder having one end thereof fixed and the other end thereof operatively connected to said lift arm intermediate said lift rod and said cam follower.

6. The lifting system described in claim 1, wherein the highest lift position for said camming profiles is a preselected position, with the camming profiles coordinated to provide stroke lengths from different low positions for different height containers.

7. The lifting system described in claim 1, wherein said actuator means includes a series of first, second and third air cylinders wherein selected respective extensions and retractions thereof coordinate the positioning of said slide arm to position said cam follower means so as to engage particular cams for particular container heights.

8. The lifting system described in claim 7, wherein said cam follower means includes a roller.

9. The lifting system described in claim 7, wherein a first camming profile of said camming profiles is engaged by said cam follower means when all three air cylinders are extended, a last cam of said camming profiles is engaged when all three cylinders are retracted, and intermediate camming profiles are respectively engaged when the three cylinders are selectively extended and retracted.

* * * * *